United States Patent [19]

Mueller et al.

[11] Patent Number: 5,024,127

[45] Date of Patent: Jun. 18, 1991

[54] PUNCHING MECHANISM

[75] Inventors: Wolfgang F. Mueller, Wappingers Falls; George Popp, Pleasant Valley; George B. Vandergheynst, Lagrangeville, all of N.Y.

[73] Assignee: International Business Machines Corporation, Armonk, N.Y.

[21] Appl. No.: 419,873

[22] Filed: Oct. 10, 1989

[51] Int. Cl.[5] ..... B26D 1/00

[52] U.S. Cl. ..... 83/13; 83/576; 83/577; 310/15; 310/34; 335/209; 335/230

[58] Field of Search ..... 83/13, 575, 576, 577, 83/637; 72/430; 310/15, 34; 335/209, 230

[56] References Cited

U.S. PATENT DOCUMENTS

| | | | |
|---|---|---|---|
| 1,128,036 | 2/1915 | Paulero | 83/577 |
| 1,138,804 | 5/1915 | Simmen | 83/577 |
| 2,509,956 | 11/1946 | Benoit | 83/577 |
| 2,597,559 | 5/1952 | Bekey | 83/576 |
| 2,730,103 | 1/1956 | Mackta | 128/305 |
| 3,486,400 | 12/1969 | Westmijze et al. | 408/88 |
| 3,709,083 | 1/1978 | Doherty et al. | 83/575 |
| 3,841,185 | 10/1974 | Baran | 83/577 |
| 3,878,412 | 4/1975 | Kurpanek | 83/576 |

FOREIGN PATENT DOCUMENTS

| | | | |
|---|---|---|---|
| 600578 | 2/1926 | France | 83/576 |
| 705398 | 11/1930 | France . | |

OTHER PUBLICATIONS

IBM Techanical Disclosure Bulletin, vol. 26, No. 7A, Dec. 1983, "Punch Programmer with Magnetic Retract" by A. F. Coneski et al., pp. 3173-3175.

IBM Technical Disclosure Bulletin, vol. 20, No. 4, Sep. 1977, "Automated Punch Apparatus for Forming Via Holes in a Ceramic Green Sheet", by T. J. Cochran et al., pp. 1379-1380.

*Primary Examiner*—W. Donald Bray

*Attorney, Agent, or Firm*—Jeffrey L. Brandt

[57] ABSTRACT

A punching mechanism includes a permanent magnet and a pole-piece connected to one pole of the permanent magnet and spaced from the other pole by a gap. A movable coil is disposed at least partially within the gap. A punch actuator is connected to the movable coil, and conductors are provided for conducting an electrical current to the coil. Current is supplied to the coil to effect a punching action.

15 Claims, 2 Drawing Sheets

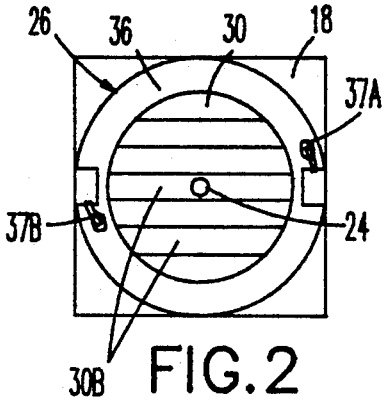
FIG.2
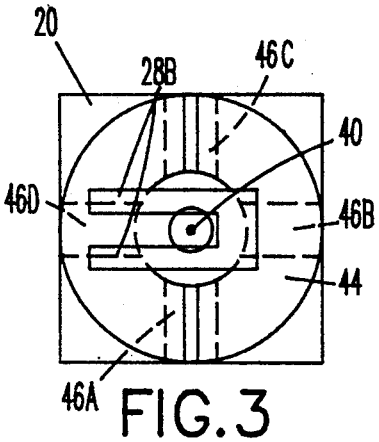
FIG.3
FIG.4
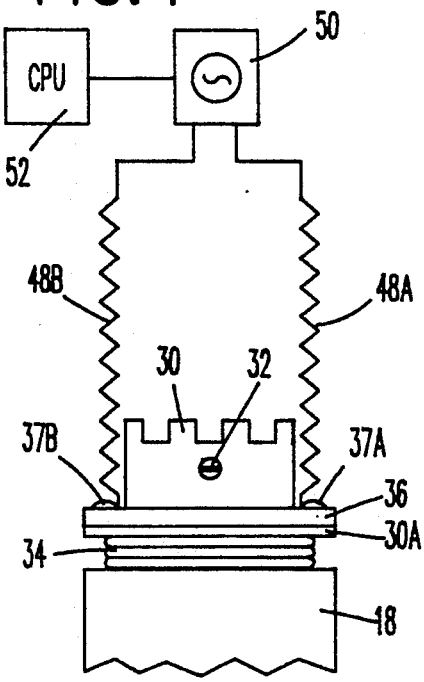
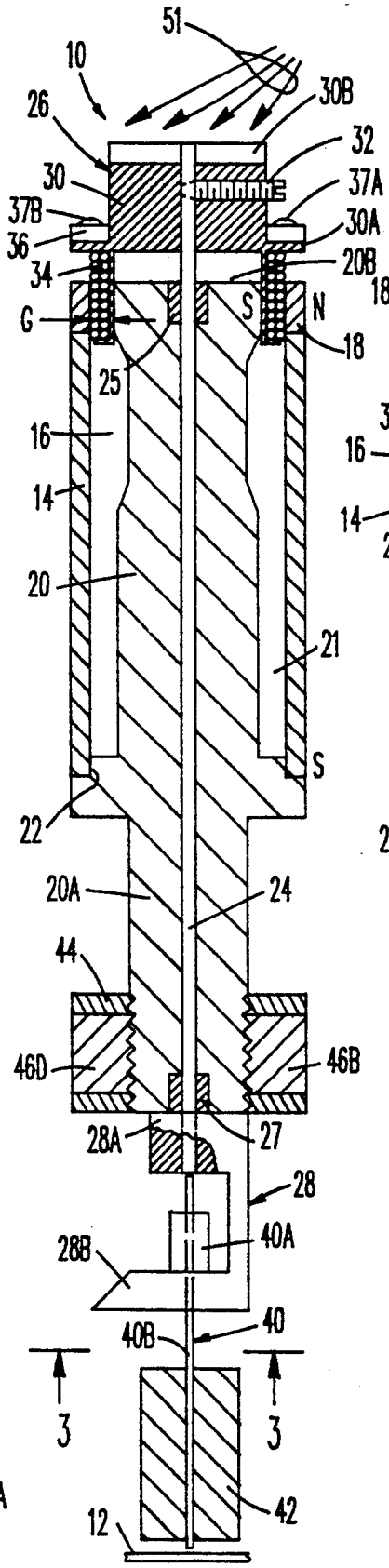
FIG.1
FIG.5
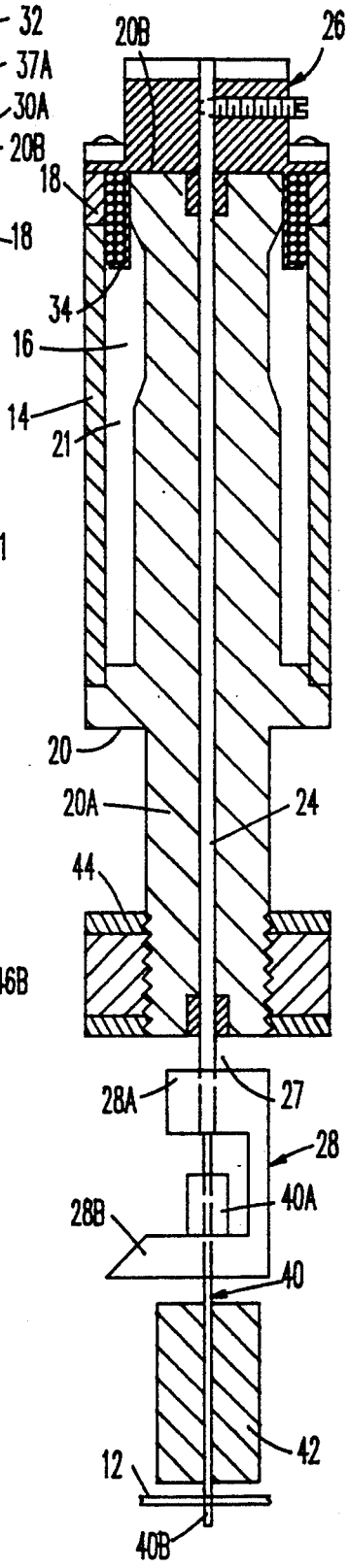

PUNCHING MECHANISM

The present invention relates generally to electromechanical mechanisms and more particularly to a punching mechanism.

BACKGROUND OF THE INVENTION

In the manufacture of multilayer ceramic (MLC) substrates for integrated circuit packages, it is necessary to punch via holes through the ceramic green-sheets. Typical ceramic sheets can require thousands of closely-spaced holes, for example on the order of 0.05 inches (0.127 cm) in diameter.

To maintain adequate through-put in the manufacture of these packages, it is usually necessary to punch many of these holes at the same time: i.e. in parallel. This requires the use of many closely positioned and simultaneously controlled punch mechanisms. High power requirements, substantial heat dissipation, and physical size limitations are exemplary of many of the problems encountered in trying to provide adequate punching systems.

Coneski, A. F., et al., "Punch Programmer with Magnetic Retract", IBM Technical Disclosure Bulletin, Vol. 26, No. 7A, pgs. 3173–3175 (December 1983) shows a punch mechanism utilizing a permanent magnet to retain a plunger in a de-energized position. A solenoid-type actuator is utilized to energize the mechanism, overcome the magnetic field of the permanent magnet, and effect the punching action.

Cochran, T. J., and Haas, R. G., "Automated Punch Apparatus for Forming Via Holes in a Ceramic Green Sheet", IBM Technical Disclosure Bulletin, Vol. 20, No. 4, pgs. 1379–1380 (September 1977) shows a punch mechanism utilizing a dual coil solenoid for punching-/retracting. Multiple punch mechanisms are arranged in close proximity and under computer control to provide desired hole patterns.

U.S. Pat. No. 1,138,804 to P. J. Simmen shows a punch wherein a spring is used to maintain a plunger in an unenergized position. A solenoid is provided which, when energized, overcomes the force of the spring to move the plunger to a neutral position. This movement of the plunger effects the perforation of a piece of paper.

U.S. Pat. No. 3,709,083 to Doherty shows an electric punch press utilizing a spring to maintain a plunger in an unenergized position. A foil-wound solenoid is provided for overcoming the force of the spring to drive the plunger and activate a punch. When the solenoid is de-energized, the spring returns the plunger to the starting position.

Solenoid-driven punch mechanisms, several types of which are illustrated above, exhibit the disadvantage of providing relatively low punching power for their substantial size and electrical power requirements. To punch MLC green-sheets of the type discussed above, it would be very desirable to provide a mechanism which provides increased punching power while requiring minimal space and electrical power.

SUMMARY OF THE INVENTION

One object of the present invention is to provide a new and improved punching mechanism.

Another object of the present invention is to provide a punching mechanism which provides substantial punching power and speed while requiring relatively low electrical power and space.

Yet another object of the present invention is to provide a punching mechanism which in operation utilizes both a permanent magnetic field and an electro-magnetic field.

In accordance with the present invention, there is provided a new and improved apparatus, particularly adapted to operate as a punching mechanism, including a permanent magnet and a pole-piece connected to one pole of the permanent magnet and spaced from the other pole of the permanent magnet by a gap. A movable coil is disposed at least partially within the gap, and means are provided for conducting an electrical current to the coil. To effect a punching action, a punch actuating means is connected to the coil such that a current can be applied to the coil to control the motion of the punch.

In accordance with another aspect of the present invention, there is provided a method comprising the steps of: establishing a permanent magnetic field; disposing a movable coil at least partially within the magnetic field; connecting punch actuating means to the movable coil; and conducting an electrical current to the coil to control the motion of the pushrod.

BRIEF DESCRIPTION OF THE DRAWINGS

These and other objects, features, and advantages of the present invention will become apparent upon consideration of the following detailed description of the invention when read in conjunction with the drawing figures, in which:

FIG. 1 shows a sectional view of a punching mechanism constructed in accordance with the present invention and in an inactive position;

FIG. 2 shows a top view of the mechanism of FIG. 1;

FIG. 3 shows a view taken along line 3—3 of FIG. 1;

FIG. 4 shows a partial view of the mechanism of FIGS. 1–3 connected to an electronic control system;

FIG. 5 is a view similar to FIG. 1 showing the mechanism in an active position.

DETAILED DESCRIPTION OF THE INVENTION

Figure 6:
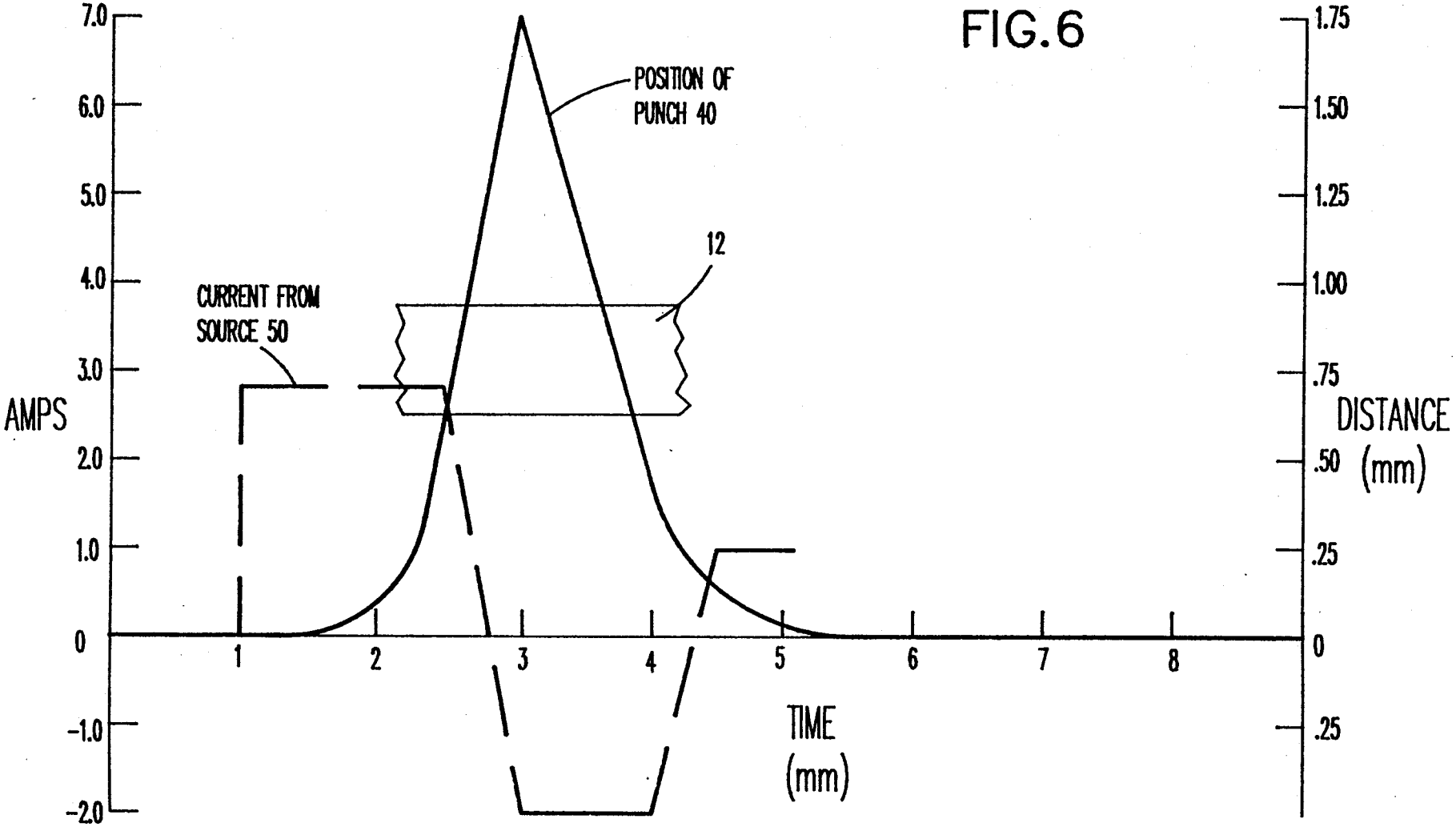
FIG. 6 is a graph illustrating the operation of the mechanism of FIGS. 1–5.

Referring now to the drawings, FIGS. 1–3 show an electro-mechanical punching mechanism 10 constructed in accordance with the present invention and positioned to punch a hole through a portion of a ceramic green-sheet 12.

Mechanism 10 includes a generally rectangular permanent magnet 14, comprised, for example of a rare earth neodimium-iron material, and defining a cylindrical chamber 16 in the interior thereof. A magnetic flux-guide 18 comprised, for example of a vanadium alloy such as vanadium permundur, is positioned on the northern pole-end of magnet 14. A generally cylindrical pole-piece 20, comprising a high-permeability metal such as vanadium permundur, is disposed concentrically within chamber 16, and connected to the south pole-end of magnet 14 at juncture 22. Pole-piece 20 includes a portion 20A extending axially outward from the end of cylinder 16 opposite flux-guide 18, and an upper surface 20B aligned with the upper end surface of the flux-guide. An upper portion of the outer cylindrical surface of pole-piece 20 is spaced from flux-guide 18 by a gap G. With magnet 14, pole-piece 20, and flux-guide 18 thus positioned, a strong, permanent magnetic field is established: starting at the North pole of the magnet, extending downward through the magnet and the junction 22 between the magnet and the pole-piece, extending upward through the pole-piece to the South pole established adjacent pole-piece surface 20B, and across gap G. This permanent magnetic field across gap G comprises an important feature of the present invention.

A metal pushrod 24, comprising for example tungsten carbide, is disposed concentrically within magnet 14 and pole-piece 20, extending axially through a chamber 21 defined within the pole-piece. The upper end of pushrod 24 extends outward of pole-piece surface 20B and into a bobbin or cap 26, while the lower end of the pushrod extends outward of pole-piece portion 20A and into a bracket or yoke 28. Bushings 25, 27 are disposed in opposite ends of pole-piece 20 for guiding the motion of pushrod 24.

Cap 26 includes a generally cylindrical body portion 30 comprised of a hard, non-magnetic material such as aluminum, a plastic, or a resin. Cap body 30 includes a concentric, axially directed aperture into which pushrod 24 extends, and a perpendicular, threaded, screw-hole for accepting a set screw 32 to secure pushrod 24 in place. A notch is preferably supplied on pushrod 24 to be engaged by the tip of set screw 32 in the manner shown. Cap body 30 further includes a rim portion 30A disposed radially around the portion of the cap body adjacent flux-guide 18, and cooling fins 30B disposed on the upper surface of the cap.

A coil 34 is suspended from rim 30A, a portion of the coil extending into gap G between pole-piece 20 and flux-guide 18. Coil 34, a key feature of the present invention, is dimensioned to slidingly engage gap G, and preferably comprises what is known in the art as a voice coil. Coil 34 can comprise, for example, four layers of No. 36 magnet wire wound about a dielectric form. A disc-shaped circuit board 36 sets atop rim 30A, and includes electrical connections 37A, 37B to opposite winding ends of coil 34.

Yoke 28, at the opposite end of pushrod 24 from cap 26, is generally C-shaped and is fixed to the pushrod at a top leg 28A, the pushrod extending into the leg in a forced, brazed, or soldered connection. Yoke 28 further includes a chamfered, bifurcate lower leg 28B (best seen in FIG. 3), the bifurcation extending in a plane generally perpendicular to the axis of pushrod 24. Yoke 28 is formed of a magnetizable material such as iron.

A conventional metal punch 40 is shown positioned in yoke 28, the punch including a collar region 40A cradled in the yoke between legs 28A, 28B. Punch 40 further includes a shaft 40B extending from collar 40A through the bifurcation in yoke leg 28B and towards green-sheet 12. It is thus seen that punch 40 is supported generally coaxially with pole-piece 20. A portion 42 of a bracket is shown slidably supporting shaft 40B in a punching position relative to green-sheet 12.

Disposed on a lower, threaded end of pole-piece portion 20A is a matchingly threaded nut 44. Nut 44 includes four generally orthogonal slots for supporting four permanent magnets 46A, 46B, 46C, 46D. Magnets 46A–46D are positioned with their poles arranged so as to augment a magnetic field attracting yoke 28 against pole-piece 20.

To provide the reader with a perspective of the size of mechanism 10 as described above, a working model of the mechanism has been assembled which has an overall length (from yoke leg 28B to fins 30B at the top of bobbin 26) of less than 2 inches, and a width across one side of rare-earth magnet 14 of less than ½ inch.

In operation, described now with respect to FIGS. 4, 5, and 6, coil 34 is connected via contacts 37A, 37B and a pair of beryllium-copper coil springs 48A, 48B, to a current generating signal source 50. A central processing unit 52 functioning as a controller is connected so as to control source 50. (It will be appreciated that source 50 and CPU 52 comprise conventional commercial units, and are shown out of size scale in FIG. 4.) Coil springs 48A, 48B are comprised of very thin metallic strips, so as to reliably conduct current between source 50 and coil 34, while effecting no significant mechanical forces on mechanism 10. Forced air 51 is directed against fins 30B of cap 26 for cooling. Optionally, a ferro-fluid/cooling fluid can be disposed within gap G.

When mechanism 10 is in the inactive or starting position as shown in FIG. 1, the magnetic forces established by pole-piece 20 and magnets 46A–46D are sufficient to maintain yoke 28 against pole-piece portion 20A. Because no current is supplied to coil 34, the magnetic field established across gap G has no mechanical affect on the coil or associated punching elements.

Referring now to FIG. 6, a graph is provided wherein: the left vertical axis represents the current in amps generated by source 50, the right vertical axis represents the distance in millimeters (mm) moved by punch 40 as a result of the actuation of mechanism 10, and the horizontal axis represents time in milliseconds (ms). A portion of green-sheet 12 is represented symbolically a distance of about 0.60 mm from the starting point of punch 40. This starting position of mechanism 10, shown in FIG. 1, is also shown at the "0" time mark in FIG. 6 whereat current from source 50 and the position of punch 40 are both at "0".

Continuing with reference to FIG. 6, a 3.0 amp current pulse is applied to coil 34 at time 1 ms. This current causes coil 34 to generate a strong electromagnetic force. The electromagnetic force generated by energized coil 34 interacts with the permanent magnetic field established across gap G, resulting in a rapid acceleration of the coil 34, bobbin 26, pushrod 24, yoke 28, and hence punch 40 in the direction of ceramic green-sheet 12. In less than 2 ms (at time 2.2 ms), the current from source 50 is returned to zero while the momentum of the moving elements of mechanism 10 continues the motion of punch 40 through green-sheet 12. This motion continues until cap 26 impacts surface 20B of pole-piece 20, whereat the motion is stopped. FIG. 5 illustrates mechanism 10 with cap 26 abutting pole-piece surface 20B and punch 40 extending through green-sheet 12. This same position is illustrated in FIG. 6 at time 3 ms when the position of punch 40 has reached its greatest extension from the "0" starting position. When cap 26 impacts pole-piece 20B, a recoil force is established between cap 26 and the pole-piece.

At time 2.8 ms, the polarity of the current supplied to coil 34 is reversed (going to −2.0 amps at time 3 ms). The electromagnetic forces thus generated assist the mechanical recoil force described above in accelerating the coil, bobbin, pushrod, yoke and punch (elements described above) in a direction away from green-sheet 12. In about 2 ms after mechanism 10 has reached its fully activated position (FIG. 5), it is returned to the starting position (FIG. 1). Magnets 46A–46D maintain yoke 28 against pole-piece 20, supporting mechanism 10 in the starting position. Additionally, a holding current of about 1 amp can be applied to coil 4 (shown at time 4.5 ms) to assist in maintaining the mechanism in the starting position.

There is thus provided a punching mechanism which utilizes an electronic coil in a permanent magnetic field to effect punching power for punching vias in ceramic green-sheets. The mechanism requires very little electrical power, and can be fabricated of a size sufficiently small to fit in a single chip site. Further, the mechanism is capable of extremely fast action, completing a single punch in less than 5 ms.

The present invention has application in the fabrication of semiconductor device packages, and more specifically can be used in large quantities in systems for punching ceramic green-sheets to fabricate semiconductor device packages.

While the present invention has been shown and described with respect to specific embodiments, it is not so limited. The present invention further includes such changes modifications, and improvements as are apparent to those skilled in the art.

What is claimed is:

1. Apparatus for driving a punch comprising:
a permanent magnet;
a pole-piece connected to one pole of said permanent magnet and spaced from the other pole of said permanent magnet by a gap;
a movable coil disposed at least partially within said gap;
means connected to said movable coil for engaging and actuating said punch; and
means for conducting an electrical current to said coil.

2. The apparatus of claim 1 wherein said actuating means includes a pushrod connected to said movable coil.

3. The apparatus of claim 2 and further including a metal yoke connected to said pushrod and positioned to be magnetically supported by said pole-piece when no current is supplied to said coil.

4. The apparatus of claim 3 wherein said yoke is shaped to connect said punch to said pushrod so that said punch is actuated by said pushrod when current is applied to said coil.

5. Apparatus comprising:
a permanent magnet defining a cylindrical first bore;
a pole-piece disposed concentrically within said permanent magnet attached to one pole of said permanent magnet and spaced from the other pole by a gap, said pole-piece defining a concentric second bore;
a movable cylindrical coil disposed concentrically with said permanent magnet and said pole-piece and extending at least partially into said gap;
a pushrod connected to said coil and extending into said second bore; and
means for conducting an electrical current to said coil.

6. The apparatus of claim 5 and further including:
a punch; and
means for connecting said punch to said pushrod such that said punch is operable by said pushrod when a current is applied to said coil.

7. The apparatus of claim 6 and further including a cap supporting said coil and said pushrod and movable axially with respect to said pole-piece.

8. The apparatus of claim 7 wherein said conducting means includes at least one electrical conductor connected to said cap.

9. The apparatus of claim 5 and further including a magnetic yoke connected to said pushrod and positioned to be magnetically supported by said pole-piece when no current is supplied to said coil.

10. The apparatus of claim 9 and further including at least one permanent magnet disposed on said pole-piece proximate said yoke and positioned so as to reinforce the magnetic attraction of said pole-piece to said yoke.

11. The apparatus of claim 5 and further including means for providing a current signal connected to said conducting means.

12. A method comprising the steps of:
establishing a permanent magnetic field;
disposing a movable coil at least partially within said magnetic field;
connecting punch actuating means to said movable coil; and
conducting an electrical current to said coil to control the motion of said punch actuating means.

13. The method of claim 12 wherein said step of establishing a permanent magnetic field comprises the steps of;
providing a permanent magnet; and
positioning a pole-piece connected to one pole of said permanent magnet and spaced from the other pole of said permanent magnet by a gap.

14. The method of claim 13 wherein said movable coil is disposed at least partially within said gap.

15. The method of claim 12 wherein said step of conducting an electrical current includes the steps of:
conducting an electrical current of a first polarity to said coil to effect the motion of said punch actuating means in a first direction; and
conducting an electrical current of a second polarity to said coil to effect the motion of said punch actuating means in a second direction.

* * * * *

UNITED STATES PATENT AND TRADEMARK OFFICE

CERTIFICATE OF CORRECTION

PATENT NO. : 5,024,127 (FI9-88-028)

DATED : June 18, 1991

INVENTOR(S) : Wolfgang F. Mueller, e t al

It is certified that error appears in the above-identified patent and that said Letters Patent is hereby corrected as shown below:

In the Drawing:

Regarding FIGURE 6; Sheet 2 of 2:

At left margin, delete "AMPS" and insert --Current (amps)--.

At right margin, under "Distance" delete "(mm)" and insert --(ms)--.

Signed and Sealed this

Eighth Day of June, 1993

*Attest:*

*Attesting Officer*

Michael K. Kirk

MICHAEL K. KIRK

*Acting Commissioner of Patents and Trademarks*